US006339850B1

(12) United States Patent
Gore

(10) Patent No.: US 6,339,850 B1
(45) Date of Patent: Jan. 22, 2002

(54) TOILET INCLUDING AN APPARATUS SUPPLYING DETERGENT TO THE WATER TANK

(76) Inventor: David Roman Gore, 7373 E. Iowa Ave, #1095, Denver, CO (US) 80231

( * ) Notice: Subject to any disclaimer, the term of this patent is extended or adjusted under 35 U.S.C. 154(b) by 0 days.

(21) Appl. No.: 09/166,713

(22) Filed: Oct. 5, 1998

(51) Int. Cl.[7] ..... E03D 9/03
(52) U.S. Cl. ..... 4/227.2; 4/353
(58) Field of Search ..... 4/224, 225.1, 227.1, 4/227.2, 227.3, 353, 415

(56) References Cited

U.S. PATENT DOCUMENTS 2,183,677 A * 12/1939 Heath ..... 4/415 X
3,187,947 A * 6/1965 Ellis ..... 4/227.3
5,603,126 A * 2/1997 Scoggins ..... 4/225.1

* cited by examiner

*Primary Examiner*—Robert M. Fetsuga

(57) ABSTRACT

The apparatus consists of a mechanism for supplying water to the toilet and flushing water into lavatory, a vessel with solid cleaning detergent in a saturated solution, a portioning mechanism and a water supplying mechanism. The portioning mechanism supplies equal portion saturated or strong detergent solution into tank with every flush. The water supplying mechanism adds water into the vessel and keeps high level of the detergent solution in the vessel. Because the vessel consists several solid detergent tablets and it is full of saturated detergent solution, and because the portion of the detergent solution pouring into the toilet tank is a small fraction of the volume of the solution in the vessel, and an equal portion water has been supplied after each, the solution of the detergent is always saturated. Because the portion of the detergent solution dispensed is always equal the concentration of the detergent in the water of tank is always equal until the last tablet is dissolved. Because the vessel has many tablets which is slowly dissolved only when the solution become slightly weaker after leaking the small portion of the solution into tank the apparatus will work many times longer compare existing arts without the necessity of adding new tablets.

12 Claims, 6 Drawing Sheets

TOILET INCLUDING AN APPARATUS SUPPLYING DETERGENT TO THE WATER TANK

BACKGROUND OF INVENTION

1. Field of Invention

This invention related to the sanitary industry.

2. Brief Description of the Prior Arts

All existing solid tablet toilet cleaners last 1000–2000 flushes with doses of detergent much more saturated when new is at end. Also they are much more saturated when time between flushes are large than when it very short. These are significant disadvantages.

VANISH POWER SYSTEM (patent pending) partly solve this problems. But it also last 1000–2000 flushes without refilling and concentration of the solution in the tank still depends on size of remaining piece of tablet and on time between the flushes.

Our APPARATUS FOR SUPPLYING LIQUID DETERGENT TO THE WATER TANK OF A TOILET (application Ser. No. 08/896,560, filing date Jul. 18, 1997) works only with liquid detergent.

SUMMERY OF INVENTION

The principal object of this invention is to provide people with an apparatus supplying an equal portion of cleaning detergent into toilet tank with each flush.

Another object of this invention to provide people with an apparatus which use solid tablets of a sanitary detergent and gives much many portions of the cleaning detergent before refill.

In accordance with the aims of this invention, preferable embodiment of the apparatus includes:

1. a vessel with an outlet,
2. a portioning and a water supplying mechanism

THE DESCRIPTION OF PREFERRED EMBODIMENT

Figure 1:
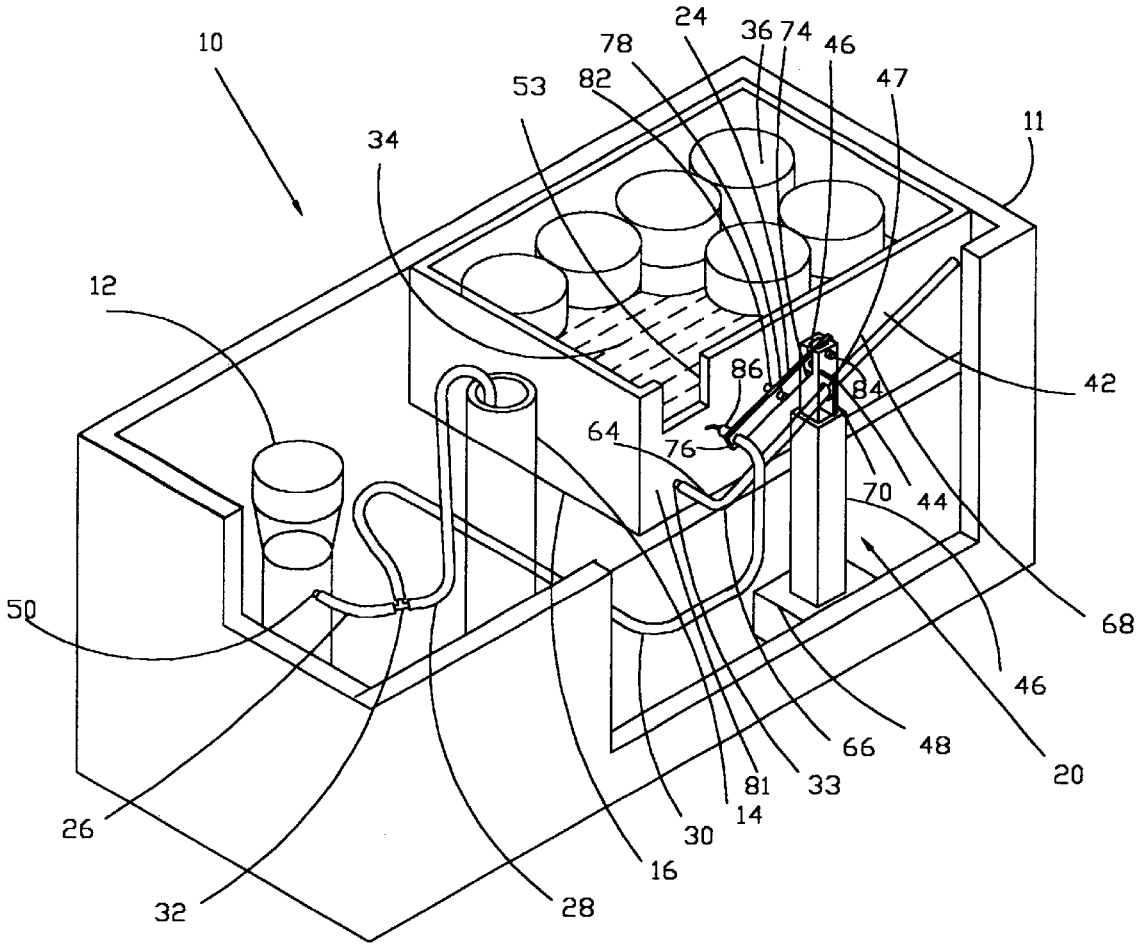
FIG. 1. Is the perspective view of the apparatus where every portion of the detergent solution dispensed from the vessel is compensated for by portion of water.
Figure 2:
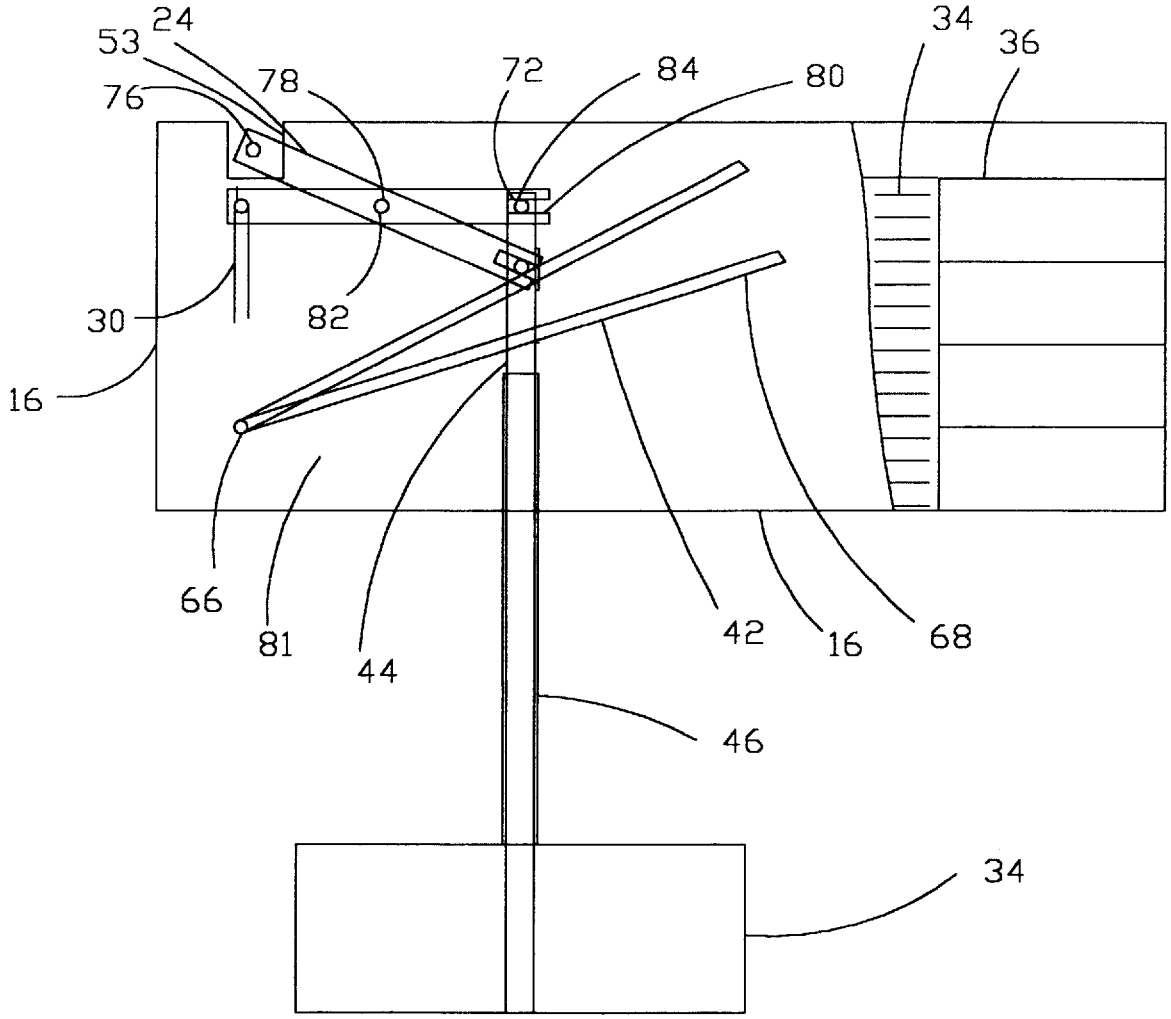
FIG. 2. Is the front view of the vessel with supplying and portioning mechanism of the apparatus where every portion of the detergent solution dispensed from the vessel is compensated for by portion of water.

An apparatus for supplying detergent to the water where every portion of the detergent solution dispensed from the vessel is compensated for by portion of water is shown in FIGS. 1 to 6.

The apparatus (10) consists of a toilet water tank (11), a valve (12), an overflow pipe (14), a vessel (16), a water supplying and portioning mechanism (20).

The water supplying and portioning mechanism (20) consists of lever (24), a first tube (26), a second tube (28), a third tube (30), a 3 way connector (32), a detergent tube (42), a slide (44), a slide guide (46) and a float (48).

The valve (12) has an outlet (50). The first tube (26) is connected with the outlet (50) and the 3 way connector (32). The second tube (28) is connected to the 3 way connector (32) on of one its end and is open on the other end. This end is located into overflow pipe (14) and supply water to the tank (11) after flush. The third tube (30) is connected to the 3 way connector (32) on one end and is open on its other end. The inside diameter of the third tube (30) is much smaller than the inside diameter of the first tube (26) and second tube (28). So the water stream coming from the valve (12) through tube (26) is divided on large stream coming into the second tube (28) and into small stream coming into the third tube (30).

The vessel (16) is mounted in a water tank (11) and has an outlet (33) and a notch (53). A detergent solution (34) and a detergent tablet (36) are located into the vessel (16).

The detergent tube (42) consist of a first rigid part (64), then a median bendable part (66) and a second rigid part (68). It is connected to the outlet (33) by the first rigid part (64) and it is open on the second rigid part (68).

The slide (44) can freely slide along a slide guide (46). The float (48) is mounted on the lower end of the slide (44). The upper end of the slide (44) has a slide axle hole (72), and a slot (74).

A detergent tube guide (70) is mounted on the upper end of the slide (44) and it has a detergent tube hole (47)

The lever (24) has a water tube hole (76), a lever axle hole (78) and a lever slot (80). A lever axle (82) is mounted on the wall (81) of the vessel (16) and located in lever axle hole (78).

The lever (24) can be rotated around the lever axle (82). A slide axle (84) is mounted into the slide axle holes (72) and located inside the lever slot (80).

Figure 3:
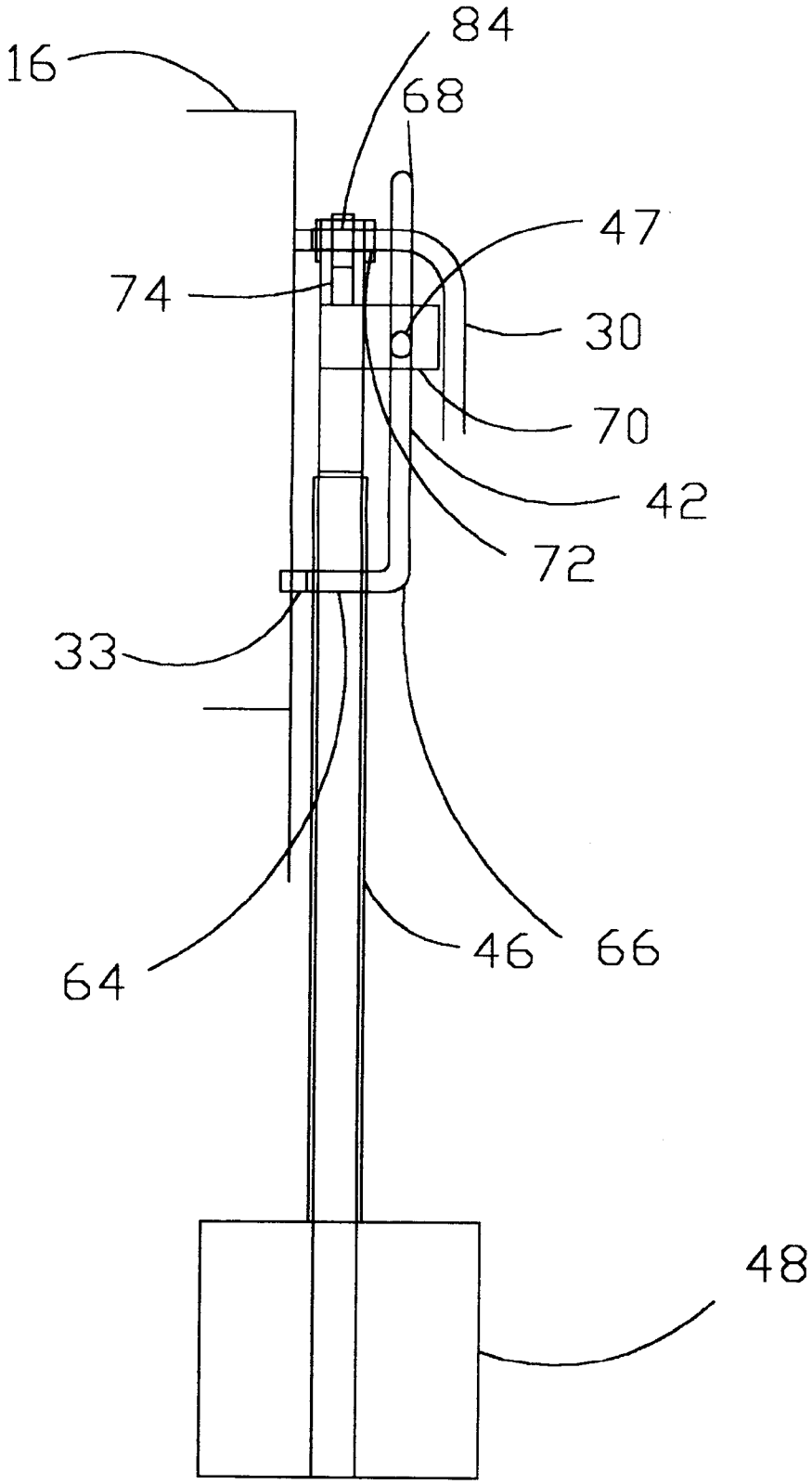
FIG. 3. Is the elevation view of the vessel with supplying and portioning mechanism of the apparatus where every portion of the detergent solution dispensed from the vessel is compensated for by portion of water.
Figure 4:
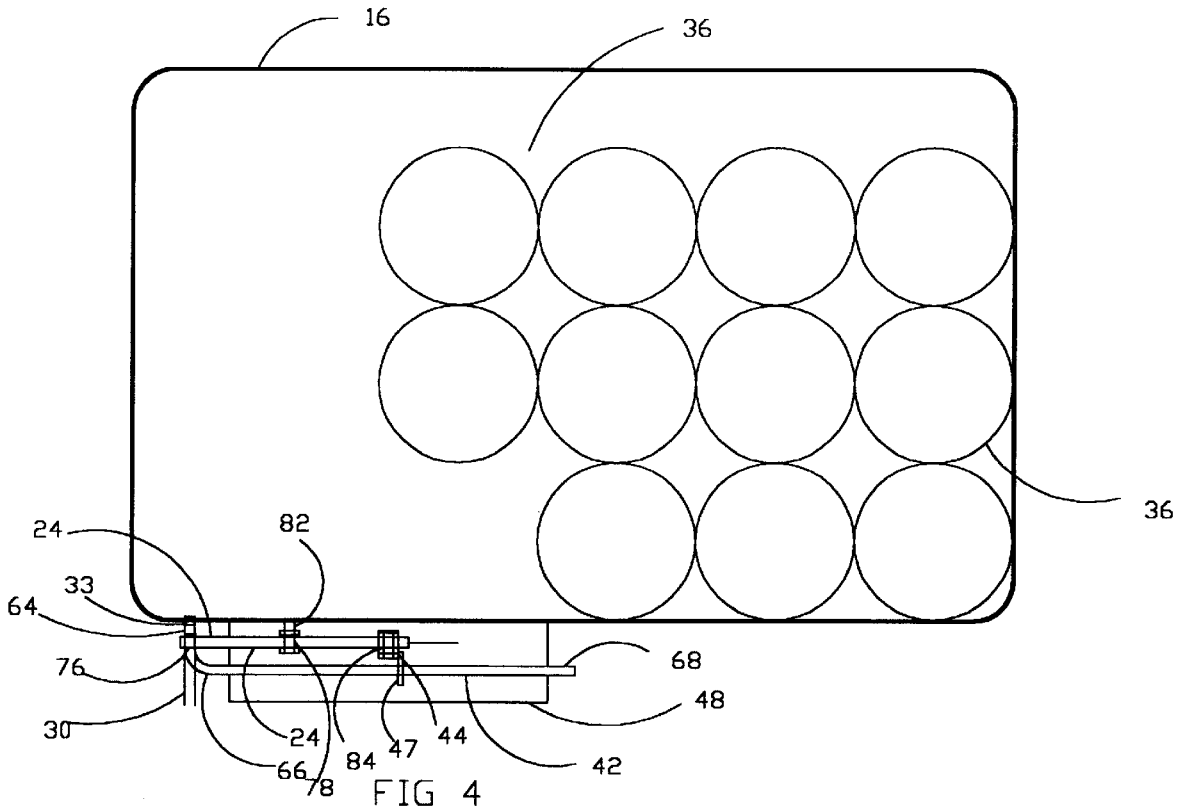
FIG. 4. Is the top view of the vessel with supplying and portioning mechanism of the apparatus where every portion of the detergent solution dispensed from the vessel is compensated for by portion water.

The second rigid part (68) of the detergent tube (42) is located into the detergent tube hole (47) (See FIG. 3). An end (86) of the third tube (30) is mounted into the water tube hole (76).

The position of the lever (24), of the end (86) of the third tube (30) and the second rigid part (68) of the detergent tube (42) depends on the position of the slide (44). When the slide (44) is in the up position the second rigid part (68) is in up and the end (86) of the third tube (30) is in down position, so detergent solution is not pouring from the vessel (16) and the water from the third tube (30) is pouring lower of the notch (53) and entering the tank (11). When the slide (44) is in down position the second rigid part (68) is down and the end (86) of the third tube (30) is in up position, so detergent solution enters from the vessel (16) into tank (11) and the water from the third tube (30) is pouring through of the notch (53) into the vessel (16). It happened when water in the tank (11) is in the lowest level after flushing.

The portion of the water reaching the detergent solution in the vessel (16) is slightly larger that the portion of the detergent solution leaking from the detergent tube (42). This small portion of extra water (or detergent solution) will leak through the notch (53) in the tank (11).

Figure 5:
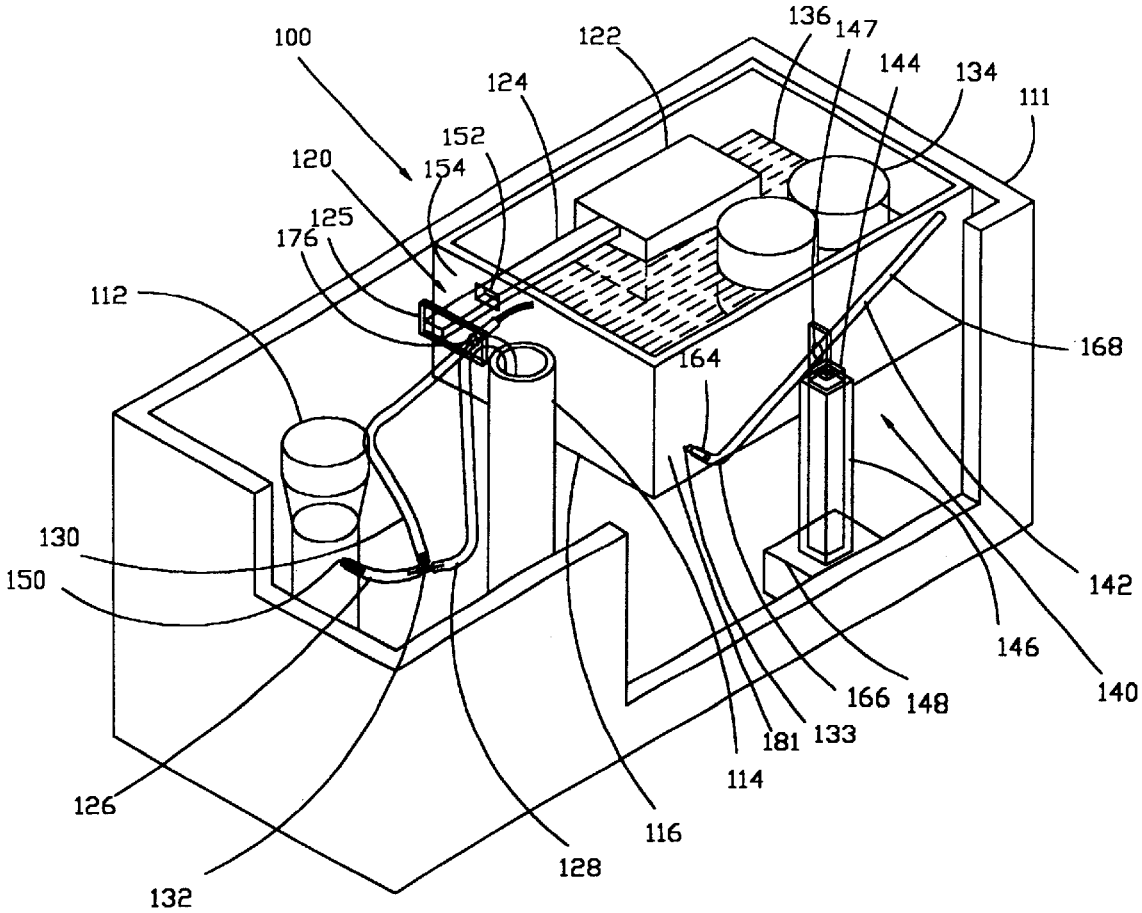
FIG. 5. Is the perspective view of the apparatus where the level of the detergent solution is controlled by a detergent float.

An apparatus where the level of a detergent solution is controlled by detergent float is shown in FIG. 5.

The apparatus (100) consists of a valve (112), an overflow pipe (114), a vessel (116), a water supplying mechanism (120) and a portioning mechanism (140)

The water supplying mechanism 120) consists of a solution float (122), a lever (124), a water tube guide (125), a first tube (126), a second tube (128), a third tube (130) and a 3 way connector (132).

The vessel (116) has a detergent tablets (134) and a detergent solution (136)

The portioning mechanism (140) consists of a detergent tube (142), a slide (144), a detergent tube guide (147) and a slide guide (146).

The valve (112) has an outlet (150). The first tube (126) is connected with the outlet (150) and the 3 way connector (132). The second tube (128) is connected to the 3 way connector (132) on one it's end and is open on it other end. This end is located into overflow pipe (114) and supplies water to the tank (111) after flush. The third tube (130) is connected to the 3 way connector (132) on one end and is open on its other end. The inside diameter of the third tube (130) is much smaller than inside diameter of the first tube (126) and second tube (128). So the water stream coming from the valve (112) through tube (126) is divided on large stream coming into the second tube (128) and into small stream coming into the third tube (130). The end of the third tube (130) is mounted into the hole (76) of the water tube guide (125).

The lever (124) is mounted on the wall (154) of the vessel (116) and can be rotated around the axes parallel to upper edge of the wall (154). The water tube guide (125) is mounted on the one end of the lever (124) The solution float (122) is mounted on the other end of the lever (124). The solution float (122) floats on the detergent solution (130) of the vessel (116). Position of the solution float (122), the lever (124) and the end of the third tube (130) depend on the level of solution (136) in the vessel (116). When the level of the solution (136) is high the water is coming during flushing from pipe-line through the valve (112) and exiting from the ends of the second tube (128) into overflow pipe (114) and from the end of the third tube (130) into the tank (111). When the level of the solution (136) is low, the end of the third tube (130) is in the higher position and pours water into the vessel (116) while flushing. Because the vessel (116) regularly contents a much more solid tablets of detergent than necessary for saturating the solution the concentration of the solution, is about the same until last of the tablets dissolves.

Figure 6:
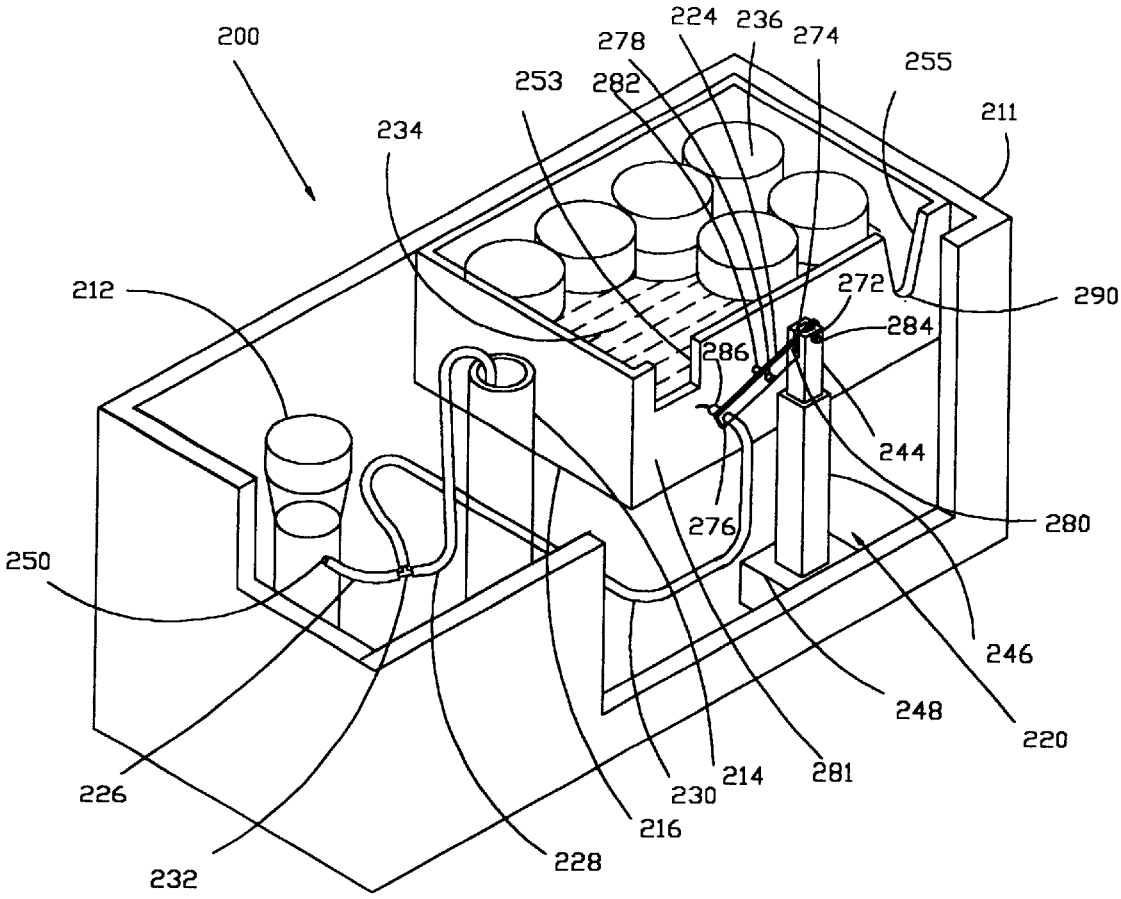
FIG. 6 is the perspective view of the apparatus for supplying detergent to the water tank where a portion of water is added to the detergent solution with each flush and forming the same portion of the solution to pour into the water tank.

An apparatus for supplying detergent to the water tank where a portion of water is added to the detergent solution with each flush and forming the same portion of the solution to pour into the water tank is shown in FIG. 6.

The apparatus (200) consists of a toilet water tank (211), a valve (212), an overflow pipe (214), a vessel (216), a water supplying and portioning mechanism (220).

The valve (212) has an outlet (250). The water supplying and portioning mechanism (220) consists of lever (224), a first tube (226), a second tube (228), a third tube (230), a 3 way connector (232), a slide (244), a slide guide (246) and a float (248).

The first tube (226) is connected with the outlet (250) and the 3 way connector (232). The second tube (228) is connected to the 3 way connector (232) on of one its end and is open on the other end. This end is located into overflow pipe (214) and supply water to the tank (211) after flush. The third tube (230) is connected to the 3 way connector (232) on one end and is open on its other end. The inside diameter of the third tube (230) is much smaller than the inside diameter of the first tube (226) and second tube (228). So the water stream coming from the valve (212) through tube (226) is divided on large stream coming into the second tube (228) and into small stream coming into the third tube (230).

The vessel (216) is mounted in a water tank (211) and has notches (253) and with the notch (255) as being a detergent delivery means. A detergent solution (234) and a detergent tablet (236) are located into the vessel (216).

The slide (244) can freely slide along a guide (246). The float (248) is mounted on the lower end of the slide (244). The upper end of the slide (244) has a slide axle hole (272).

The lever (224) has a water tube bole (276), a lever axle hole (278) and a lever slot (280). A lever axle (282) is mounted on the wall (281) of the vessel (216) and located in lever axle hole (278).

The lever (224) can be rotated around the lever axle (282). A slide axle (284) is mounted into the slide axle holes (272) and located inside the lever slot (280).

What is claimed is:

1. A toilet including an apparatus for flushing water from a water storage tank to a toilet bowl and automatically supplying detergent to the water storage tank comprising in combination: a source of water, a valve for regulating the flow of water from said source to said tank, a vessel in said tank, a supply of solid detergent and a detergent solution in said vessel, a water supply means for selectively delivering water to said vessel during a portion of the time water is flowing into said tank to react with said solid detergent to form detergent solution, and a detergent supply means, and wherein said water supply means and said detergent supply means are responsive to the water level in said tank such that when the water level in the tank is lowered as when the apparatus is flushed, said water supply means delivers water to said vessel during a portion of the time water is flowing into said tank and said detergent supply means deliver said solution from said vessel to said tank.

2. The toilet of claim 1 wherein said detergent supply means includes a water float, a slide, a slide guide, a vessel tube and a vessel tube guide; said vessel having an outlet; said vessel tube having first rigid end, median bendable part and a second rigid end; said first rigid end being connected to said outlet; said second rigid end being opened and free for movement; said slide being adapted to slide along said slide guide; said water float being mounted on a first end of said slide; said vessel tube guide having a vessel tube hole and being mounted on a second end of said slide; said second end of said vessel tube being positioned into said vessel tube hole of said vessel tube guide; said water float with said slide and said vessel tube guide being adapted to move said second rigid end of said vessel tube from first to second position.

3. The toilet of claim 2 wherein said water supply means includes a selective supply tube, a selective supply tube guide, a detergent float and a detergent lever; said detergent float being mounted on a first end of said detergent lever and being floated on said detergent solution; said supply tube guide being mounted on a second end of said detergent lever; said selective supply tube connected with said valve on a first end and being open on a second end; said second end of said selective supply tube being mounted on said supply tube guide; said selective supply tube with said detergent float, said detergent lever and said selective tube guide being adapted to selectively supply water to said vessel or to said tank in response to changing a level of said detergent solution.

4. The apparatus of claim 2 wherein said water supply means includes a selective supply tube, a vessel lever having an axle hole, a slot and a selective supply tube hole; said selective supply tube being operatively connected with said valve on a first end and being open on a second end; said vessel has a vessel lever axle mounted on a vessel wall; said vessel lever being in communication with said slide and being adapted to rotate around said vessel lever axle; said second end of said selective supply tube being mounted into said selective supply tube hole; said water float with said slide and said vessel lever being adapted to move said second end of said selective supply tube from a first to a second position.

5. A toilet including an apparatus for flushing water from a water storage tank to a toilet bowl and automatically supplying detergent to the water storage tank comprising in combination: a source of water, a valve for regulating the flow of water from said source to said tank, a vessel in said tank, a supply of solid detergent and a detergent solution in said vessel, a water supply means and a detergent supply means; wherein said water supply means delivers water to the vessel and said detergent supply means delivers detergent solution from said vessel to said tank, and a tubing means; said tubing means adapted to divide the water stream coming from said valve in a large stream and a small stream; said large stream going to said tank; said small stream going to said tank, or to said vessel; said water supply means adapted to change of direction said small stream from said tank to said vessel in response to the water level in said tank such that when the water level in the tank is lowered as when the apparatus is flushed, said water supply means delivers water to the vessel and said detergent supply means delivers detergent solution from the vessel to the tank.

6. The toilet of claim 5 wherein said tubing means having a valve tube, a tank supply tube, a three-way connector and a selective supply tube; a first end of said valve tube being connected to said valve, a second end of said valve tube being connected to a first end of said three-way connector; said tank supply tube being connected to a second end of said three-way connector on one end and being open to said tank on a second end; said selective supply tube being connected to a third end of said three-way connector on a first end and being open on a second end.

7. The toilet of claim 6 wherein said detergent supply means includes a water float, a slide, a slide guide, a vessel tube and a vessel tube guide; said slide being adapted to slide along said slide guide; said water float being mounted on first end of said slide; said vessel having an outlet; said vessel tube having a first rigid end, a median bendable part and a second rigid end; said first rigid end being connected to said outlet; said second rigid end being opened and free for movement; said water float being mounted on said first end of said slide; said vessel tube guide having a vessel tube hole and being mounted on the a second end of said slide; said second end of said vessel tube being positioned into said vessel tube hole of said vessel tube guide; said water float with said slide and said vessel tube guide being adapted to move said second rigid end of said vessel tube from a first to a second position.

8. The toilet of claim 7 wherein said water supply means includes a vessel lever; said vessel lever having an axle hole, a slot and a selective supply tube hole; said vessel has a vessel lever axle mounted on a vessel wall; said vessel lever being in communication with said slide and being adapted to rotate around said vessel lever axle; said second end of said selective supply tube being mounted into said selective supply tube hole; said water float with said slide and said vessel lever being adapted to move said second end of said selective supply tube from a first to a second position.

9. The apparatus of claim 7 wherein said water supply means includes a selective supply tube guide, a detergent float and a detergent lever; said detergent float being mounted on a first end of said detergent lever and being floated on said detergent solution; said supply tube guide being mounted on a second end of said detergent lever; said second end of said selective supply tube being mounted on said supply tube guide; said selective supply tube with said detergent float, said detergent lever said detergent float and said selective tube guide being adapted to selectively supply water to said vessel or to said tank in response to changing a level of said detergent solution.

10. The toilet of claim 6 wherein said water supply means having a water float, a slide, a slide guide, and a vessel lever; said slide being adapted to slide along said slide guide; said water float being mounted on a first end of said slide; said vessel lever having an axle hole, a slot and a water supply hole; said vessel having a vessel lever axle mounted on a vessel wall; said vessel lever being adapted to rotate around said axle; said vessel lever being in communication with a second end of said slide; said selective supply tube hole being located near a first end of said vessel; said second end of said selective supply tube being mounted in said selective supply tube hole; said detergent supply means consists of an outlet in said vessel; said outlet beings located on a second end of said vessel; said water float with said slide and said water vessel lever being adapted to move said end of said selective supply tube from a first to a second position.

11. An toilet for flushing water from a water storage tank to a toilet and automatically supplying detergent to said water storage tank comprising in combination: a source of water, a valve for regulating the flow of water from said source to said tank, a vessel in said tank, a supply of solid detergent and a detergent solution in said vessel, a water supply means for selectively delivering a portion of water to said vessel to react with said solid detergent to form detergent solution, a detergent supply means for delivering detergent solution from said vessel to said tank, and a tubing means; said water supply means includes a water float, a slide, a slide guide, and a vessel lever; said slide being adapted to slide along said slide guide; said water float being mounted on a first end of said slide; said vessel lever being in communication with a second end of said slide; said vessel lever having an axle hole, a slot and a selective supply tube hole; said tubing means having a valve tube, a tank supply tube, a three-way connector and a selective supply tube; said valve tube being connected to said valve on a first and to a first end of said three-way connector on a second end; said tank supply tube being connected to a second end of said three-way connector on a first end and being open to said tank on a second end; said selective supply tube being connected to a third end of said three-way connector on a first end and being open on a second end; said selective supply tube hole being located near a first end of said vessel; said second end of said selective supply tube being mounted in said selective supply tube hole; said detergent supply means consists of an outlet in said vessel; said outlet is located near second end of said vessel; said water float with said slide and said vessel lever being adapted to move said end of said selective supply tube from a first to a second position.

12. A toilet including an apparatus for flushing water from a water storage tank to a toilet bowl and automatically supplying detergent to the water storage tank comprising in combination: a source of water, a valve for regulating the flow of water from said source to said tank, a vessel in said tank, a supply of solid detergent and a detergent solution in said vessel; a water supply means for selectively delivering water to said vessel to react with said solid detergent to form detergent solution and a detergent supply means, wherein said water supply means and said detergent supply means are responsive to the water level in said tank such that when the water level in the tank is lowered as when the apparatus is flushed, said water supply means delivers water to said vessel and said detergent supply means delivers said solution from the vessel to the tank; said water supply means includes a selective supply tube, a water float, a slide, a slide guide, and a vessel lever; said slide being adapted to slide along said slide guide; said water float being mounted on a first end of said slide; said vessel lever having an axle hole, a slot and a selective supply tube hole; said vessel having a vessel lever axle mounted on a vessel wall; said vessel lever being in communication with said second end of said slide and being adapted to rotate around said axle; said selective supply tube hole being located near a first end of said vessel; a first end of said selective supply tube being operatively connected with said valve; a second end of said selective supply tube being open and being mounted in said selective supply tube hole; said detergent supply means consists of an outlet in said vessel; said outlet is located on a second end of said vessel; said water float with said slide and said water vessel lever being adapted to move said end of said selective supply tube from a first to a second position.

* * * * *